US008847970B2

(12) United States Patent
Belanger

(10) Patent No.: US 8,847,970 B2
(45) Date of Patent: Sep. 30, 2014

(54) UPDATING GRAPHICAL CONTENT BASED ON DIRTY DISPLAY BUFFERS

(75) Inventor: Etienne Belanger, Kanata (CA)

(73) Assignee: 2236008 Ontario Inc., Waterloo, Ontario ( * ) Notice: Subject to any disclaimer, the term of this patent is extended or adjusted under 35 U.S.C. 154(b) by 253 days.

(21) Appl. No.: 13/449,854

(22) Filed: Apr. 18, 2012

(65) Prior Publication Data

US 2013/0278619 A1 Oct. 24, 2013

(51) Int. Cl.
*G09G 5/36* (2006.01)

(52) U.S. Cl.
USPC ..... 345/545; 345/555

(58) Field of Classification Search
USPC ..... 345/539, 536, 547–548; 715/781, 788, 715/797
See application file for complete search history.

(56) References Cited

U.S. PATENT DOCUMENTS

| | | | | |
|---|---|---|---|---|
| 5,867,166 | A | 2/1999 | Myhrvold et al. | 345/419 |
| 6,975,322 | B2 | 12/2005 | Lavelle | 345/543 |
| 7,148,897 | B2 | 12/2006 | Ecob et al. | 345/473 |
| 7,274,370 | B2 * | 9/2007 | Paquette | 345/536 |
| 7,280,120 | B2 | 10/2007 | Ecob et al. | 345/611 |
| 7,292,256 | B2 | 11/2007 | Lawther et al. | 345/629 |
| 7,315,308 | B2 | 1/2008 | Wilt et al. | 345/530 |
| 7,425,955 | B2 | 9/2008 | Long et al. | 345/421 |
| 7,425,962 | B2 | 9/2008 | Alcorn et al. | 345/556 |
| 7,530,027 | B2 | 5/2009 | MacInnis et al. | 715/768 |
| 7,543,242 | B2 * | 6/2009 | Goossen et al. | 715/797 |
| 7,545,380 | B1 | 6/2009 | Diard et al. | 345/505 |
| 7,554,562 | B2 | 6/2009 | MacInnis et al. | 345/629 |
| 7,667,710 | B2 | 2/2010 | MacInnis et al. | 345/560 |
| 7,681,200 | B2 | 3/2010 | Wong | 718/108 |
| 7,889,202 | B2 | 2/2011 | Zhang et al. | 345/505 |
| 7,991,049 | B2 | 8/2011 | MacInnis et al. | 375/240.15 |
| 8,004,535 | B2 | 8/2011 | Blaukopf et al. | 345/539 |
| 2007/0002045 | A1 | 1/2007 | Finger et al. | 345/422 |
| 2008/0042923 | A1 | 2/2008 | De Laet | 345/1.3 |
| 2008/0238928 | A1 * | 10/2008 | Poddar et al. | 345/555 |
| 2010/0058229 | A1 * | 3/2010 | Mercer | 715/788 |
| 2010/0253693 | A1 * | 10/2010 | Streatch et al. | 345/548 |
| 2011/0074800 | A1 | 3/2011 | Stevens et al. | 345/545 |
| 2011/0102446 | A1 | 5/2011 | Oterhals et al. | 345/545 |
| 2011/0193868 | A1 | 8/2011 | MacInnis et al. | 345/501 |
| 2011/0314412 | A1 | 12/2011 | Aldinger et al. | 715/781 |
| 2012/0079142 | A1 * | 3/2012 | Fleegal et al. | 710/30 |

* cited by examiner

*Primary Examiner* — James A Thompson
(74) *Attorney, Agent, or Firm* — Brinks Gilson & Lione

(57) ABSTRACT

A system improves the performance of buffering frames. After a buffer flip occurs when double buffering the frames, the system may update some portions of dirty buffer regions in a back buffer with changes between a source frame and an intermediate frame. The system may update other portions of the dirty buffer regions with changes between the intermediate frame and a target frame. An application may write to an application buffer or a display buffer depending on whether the application controls a region of the display buffer that corresponds to the application buffer.

18 Claims, 4 Drawing Sheets

UPDATING GRAPHICAL CONTENT BASED ON DIRTY DISPLAY BUFFERS

BACKGROUND

1. Technical Field

This disclosure relates to buffers and, in particular, to graphics buffers.

2. Related Art

Graphics buffers may be populated with images by a processing unit. After an image is generated in a graphics buffer, a display controller may read the image from the graphics buffer, and cause the image to be displayed in a display.

BRIEF DESCRIPTION OF THE DRAWINGS

The systems may be better understood with reference to the following drawings and description. The components in the figures are not necessarily to scale. Moreover, in the figures, like-referenced numerals designate corresponding parts throughout the different views.

DETAILED DESCRIPTION

Figure 1A:
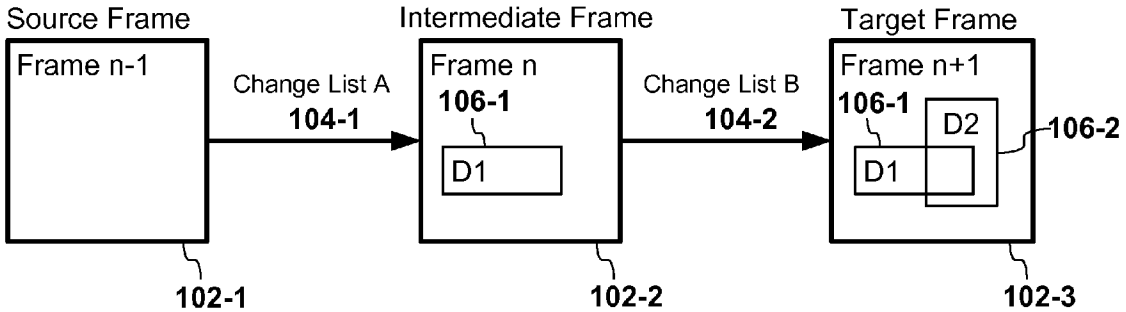
FIG. 1A is a sequence of frames to be displayed in a graphics system.

A system updates a graphics buffer that temporarily holds frames. The system may include volatile and/or non-volatile memory, a processor, a first rendering module, and a second rendering module. The processor may be a CPU (central processing unit), GPU (graphics processing unit) or graphics coprocessor and the modules may be implemented by executable code that is stored in the memory and executed by the CPU or the GPU.

Regions of the memory may be reserved for use as an intermediate repository and may include a front and a back buffer. The use of more than one buffer to hold data may enable a receiving device to receive a complete version of the data rather than partially updated versions of the data created by a transmitting device (for example, multiple buffering). In some applications, the back buffer may hold a source frame that is to be updated to a target frame; and the front buffer may hold an intermediate frame, following a buffer flip. In sequence, an intermediate frame may follow the source frame but occur earlier than the target frame. The changes between the source frame and the intermediate frame may be contained within a first set of dirty regions while the changes between the intermediate frame and the target frame may be contained within a second set of dirty regions.

The first rendering module may determine one or more of the non-intersecting portions of the dirty regions. A non-intersecting portion of the first set of dirty regions of the intermediate frame may include any portion of the first set of dirty regions of the intermediate frame that does not intersect the second set of dirty regions of the target frame. The first rendering module may update the non-intersecting portion of the first set of dirty regions of the intermediate frame in the back buffer with changes between the source frame and the intermediate frame that are applicable to the non-intersecting portion.

The second rendering module may update the second set of dirty regions of the target frame in the back buffer with the changes between the intermediate frame and the target frame. For example, the second rendering module may update the second set of dirty regions of the target frame with changes between the intermediate frame and the target frame.

In an alternative example, the second rendering module may determine and update just portions of the second set of dirty regions of the target frame that intersect the first set of dirty regions of the intermediate frame. The first rendering module, instead of the second rendering module, may determine a non-intersecting portion of the second set of dirty regions of the target frame. The non-intersecting portion of the second set of dirty regions of the target frame may include a portion of the second set of dirty regions of the target frame that does not intersect with the first set of dirty regions of the intermediate frame. The first rendering module may update the non-intersecting portion of the second set of dirty regions of the target frame in the back buffer based on changes between the intermediate frame and the target frame that are applicable to the non-intersecting portion.

FIG. 1A is a sequence of frames 102 that may be displayed in a graphics system. The frames 102 in FIG. 1A are designated frame n−1 or 102-1, frame n or 102-2, and frame n+1 or 102-3, respectively. Frame n−1 occurs before frame n in the illustrated sequence. Frame n+1 occurs after frame n in that sequence. Each one of the frames 102 may be an image in a sequence of images ordered in time and may be represented or stored in one or more graphics buffers.

A change list 104 may identify the changes to be made to one of the frames 102 to generate a following one of the frames 102. For example, change list A, 104-1, may identify changes to be made to frame n−1 in order to generate frame n, and change list B, 104-2, may identify changes to be made to frame n in order to generate frame n+1. The change list 104 may identify such changes in any number of ways. In one example, the change list 104 may include one or more graphic commands. A graphic command may be any instruction to create or modify an image or a portion thereof. For example, the graphic command may render a shape such as a circle, blit (copy) an image such as a font, or remap the color of the existing image.

The change list 104 may be generated in any number of ways. For example, the change list 104 may include graphic commands received from one or more applications, processes, devices, or a combination thereof. Alternatively or in addition, the change list 104 may include graphic commands generated from the received graphic commands. For example, the graphic commands in the change list 104 may be a subset of, a simplification of, or any other derivative of, the received graphic commands.

The changes identified in the change list 104 may be contained within one or more dirty regions 106 of the frame 102. In frame n, for example, the changes may be contained within the dirty region 106 or a portion thereof designated D1 or 106-1. In frame n−1, the changes may be contained within the dirty region 106 or a portion thereof designated D2 or 106-2. Each of the dirty regions 106 may have any shape. For example, the dirty region 106 may be rectangular, circular, polygonal, or any other type of shape. In some examples, one or more of the dirty regions 106 may include portions of the frame 102 that do not change from a preceding frame or frames 102 in addition to the portions of the frame 102 that have changed from the preceding frames 102. The graphics system may determine the dirty region 106 designated D1 by processing the change list 104 designated change list A in FIG. 1A. The graphics system may determine the dirty region 106 designated D2 by processing the change list 104 designated change list B.

Figure 1B:
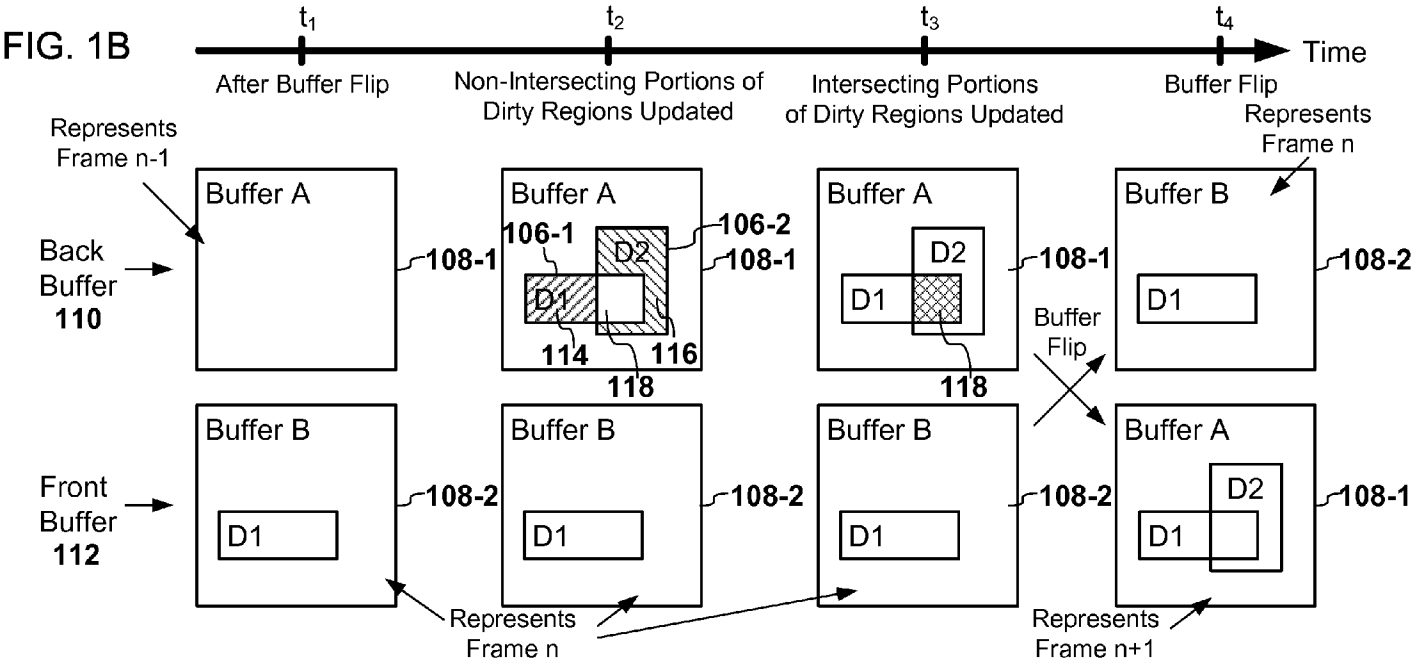
FIG. 1B is a graphics buffer based on dirty regions of frames.

FIG. 1B illustrates an example of updating graphic buffers 108 based on the dirty regions 106 of the frames 102 when changes to the frame 102 being rendered obscure changes to at least one of the frames 102 prior to the frame being rendered. In particular, FIG. 1B illustrates double buffering using two graphic buffers 108, designated Buffer A or 108-1 and Buffer B or 108-2, respectively.

The graphic buffers 108 may include or comprise application buffers or display buffers. An application that renders graphical content may store content in an application buffer. A windowing system, or composition manager, may assemble the application buffers from multiple applications to construct the frame 102 in a display buffer, which may then be displayed on a physical display screen. To assemble the display buffer, the composition manager may, for example, copy and blend the application buffers into the display buffer.

Display hardware may read from the display buffer to display the frame 102 represented in the display buffer. Changing the contents of the display buffer while the display hardware reads from the display buffer may cause tearing artifacts or other types of undesired image effects. To decrease or avoid the possibility of causing such image defects, the display buffer may be double buffered, triple buffered, or buffered using more than three display buffers.

When the display buffer is double buffered, the display buffer may include a back buffer 110 for rendering or drawing and a front buffer 112 for displaying. More generally, any buffer that the graphics system writes to in order to construct the frame 102 may be known as the back buffer 110. Any buffer that the graphics system reads the completed frame 102 from may be known as the front buffer 112. In examples in which triple buffering or any higher order buffering is used, the graphics system may use multiple back buffers.

While the composition manager writes to the back buffer 110 to create one of the frames 102, the display hardware may read from the front buffer 112 in order to cause the contents of a previous one of the frames 102 to be displayed. In response to a vertical synchronization pulse or some other event, the front buffer 112 and the back buffer 110 may be switched such that the back buffer 110 becomes the front buffer 112, and the front buffer 112 becomes the back buffer 110. The buffer switch may be referred to as a buffer flip. After the buffer flip, the back buffer 110 may include the contents of frame n−1, and the front buffer 112 may include the contents of frame n. By copying the entire contents of the front buffer 112 (frame n) to the back buffer 110 (frame n−1), the back buffer 110 will have the most recent contents (frame n), and the composition manager may begin to assemble a new frame, n+1 into the back buffer 110. The process of rendering, flipping, and displaying may be repeated.

However, copying the entire contents of the front buffer 112 to the back buffer 110 at the buffer flip may cause performance issues in some configurations. Alternative algorithms and mechanisms are provided below.

In FIG. 1B, at a starting time, $t_1$, the graphics system may cause the buffer flip to occur. As a result, Buffer B is made the front buffer 112, and Buffer A is made the back buffer 110. After the buffer flip, the front buffer 112, Buffer B, may represent the frame n, and the back buffer 110, Buffer A, may represent the frame n−1. The graphics system may proceed to generate the frame n+1 in the back buffer 110, Buffer A.

The frame 102 represented in the back buffer 110 after the buffer flip (the frame n−1) may be referred to as a source frame. The frame 102 to be generated in the back buffer 110 (the frame n+1) may be referred to as a target frame. The frame 102 between the source frame and the target frame that is in the front buffer 112 after the buffer flip (frame n) may be referred to as an intermediate frame.

At a time, $t_2$, the graphics system may update any non-intersecting portions 114 and 116 of the dirty regions 106 in the back buffer 110. The non-intersecting portions 114 and 116 of the dirty regions 106 may be the portions of the dirty regions 106 of either the intermediate frame or the target frame that do not intersect with the dirty regions 106 of the other one of the intermediate frame or the target frame. In FIG. 1B, the non-intersecting portion 114 of the dirty region 106, D1, of the intermediate frame may be the portion of the dirty region 106, D1, of the intermediate frame that does not intersect with the dirty region 106, D2, of the target frame. Similarly, the non-intersecting portion 116 of the dirty region 106, D2, of the target frame may be the portion of the dirty region 106, D2, of the target frame that does not intersect with the dirty region 106, D1, of the intermediate frame.

The graphics system may update the non-intersecting portions 114 and 116 of the dirty regions 106 in any number of ways. Some of the ways in which the graphics system may update the non-intersecting portions 114 and 116 of the dirty regions 106 are described below.

In a first example of updating the non-intersecting portions 114 and 116 of the dirty regions 106, the graphics system obtains a copy of the non-intersecting portions 114 of the dirty regions 106 of the intermediate frame. In particular, the graphics system copies the non-intersecting portions 114 of the dirty regions 106 of the intermediate frame to the back buffer 110 from a second graphics buffer that represents the intermediate frame, such as the front buffer 112. For example, the graphics system may copy the non-intersecting portion 114 of the dirty region 106, D1, of the intermediate frame to Buffer A from Buffer B. In addition, the graphics system may apply the changes identified in the change list 104 for the target frame to the non-intersecting portions 116 of the dirty regions 106 of the target frame in the back buffer 110. For example, the graphics system may apply the changes identified in the change list B to the non-intersecting portion 116 of the dirty region 106, D2, in Buffer A.

In a second example of updating the non-intersecting portions 114 and 116 of the dirty regions 106, the graphics system selectively applies the changes indicated in the change list 104 for the intermediate frame. In particular, the graphics system may modify the change list 104 for the intermediate frame or a copy thereof so that the changes indicated in the modified change list 104 affect the non-intersecting portions 114 of the dirty regions 106 of the intermediate frame but not intersecting portions 118 of the dirty regions 106 of the intermediate frame. In FIG. 1B, the graphics system may generate a modified change list A from the change list A so that the changes indicated in the modified change list A apply to the non-intersecting portion 114 of the dirty regions 106 of the intermediate frame, D1, but not to the intersecting portions 118 of the dirty regions 106, D1 and D2 of Buffer A. The graphics system may then apply the changes indicated in the modified change list 104 to Buffer A, thereby updating the non-intersecting portions 114 of the dirty regions 106 of the intermediate frame. In addition, the graphics system may apply the changes identified in the change list 104 for the target frame to the non-intersecting portions 116 of the dirty regions 106 of the target frame in the back buffer 110. For example, the graphics system may apply the changes identified in the change list B to the non-intersecting portion 116 of the dirty region 106, D2, in Buffer A.

In another example of updating the non-intersecting portions 114 and 116 of the dirty regions 106 of the intermediate frame, the graphics system may obtain a copy of the non-intersecting portions 114 of the dirty regions 106 of the intermediate frame or selectively apply the changes indicated in the change list 104 for the intermediate frame based on characteristics of each one of the non-intersecting portions 114 of the dirty regions 106 of the intermediate frame. For example, the graphics system may analyze the shape of each one of the non-intersecting portions 114 of the dirty regions 106 of the intermediate frame. If the non-intersecting portion 114 is not rectangular, then the graphics system may obtain a copy of the non-intersecting portion 114 of the dirty region 106 of the intermediate frame. On the other hand, if the non-intersecting portion 114 is rectangular, then the graphics system may apply the changes indicated in the change list 104 for the intermediate frame to the non-intersecting portion 114 of the dirty region 106 of the intermediate frame. When the graphics system obtains the copy of the non-intersecting portion 114 instead of applying the changes indicated by the change list 104, the graphics system may modify the changes identified by the change list 104 so that the changes identified by the change list 104 no longer affect the copied non-intersecting portion 114. In an alternative example, if the non-intersecting portion 114 exceeds a threshold size, then the graphics system may obtain a copy of the non-intersecting portion 114 of the dirty region 106 of the intermediate frame. On the other hand, if the non-intersecting portion 114 does not exceed the threshold size, then the graphics system may apply the changes indicated in the change list 104 for the intermediate frame to the non-intersecting portion 114 of the dirty region 106 of the intermediate frame. In yet another example, the graphics system may determine whether to copy the non-intersecting portion 114 or apply the changes indicated in the change list 104 for the intermediate frame to the non-intersecting portion 114 based on computational complexity of the changes that apply to the non-intersecting portion 114. The graphics system may analyze each one of the non-intersecting portions 114 of the dirty regions 106 of the intermediate frame, and copy or apply the changes depending on the result of the analysis.

At a time, $t_3$, the graphics system may update the intersecting portions 118 of the dirty regions 106 in the back buffer 110. The intersecting portions 118 of the dirty regions 106 may comprise any portions of the dirty regions 106 of the intermediate frame that intersect with the dirty regions 106 of the target frame.

If the changes between the intermediate frame and the target frame in the intersecting portions 118 obscure the changes between the source frame and the intermediate frame, then the graphics system may apply the changes identified in the change list 104 for the target frame to the intersecting portions 118 of the dirty regions 106 in the back buffer 110.

The graphics system may apply the changes identified in the change list 104 for the target frame to the intersecting portions 118 of the dirty regions 106 in any number of ways. For example, the graphics system may modify the commands in the change list 104 for the target frame such that the commands just modify the intersecting portions 118 of the dirty regions 106. Alternatively or in addition, the graphics system may remove a subset of the commands in the change list 104 for the target frame such that the commands just modify the intersecting portions 118 of the dirty regions 106.

When the graphics system applies the changes identified in the change list 104 for the target frame to the intersecting portions 118 of the dirty regions 106, the graphics system may not necessarily update every pixel included in the intersecting portions 118 of the dirty regions 106. For example, the intersecting portions 118 of the dirty regions 106 may include a square that circumscribes a spinning circular cursor. The spinning circular cursor may change between the source frame and the intermediate frame, and between the intermediate frame and the target frame. Pixels that are within the square intersecting portion 118 but outside of the circular cursor may not change between the source frame and the target frame. The changes between the source frame and the intermediate frame within the circular cursor may be completely overwritten by the changes between the intermediate frame and the target frame. Accordingly, the graphics system may skip applying the changes between the source frame and the intermediate frame that apply to the square intersecting portion 118 of the dirty regions 106 in the back buffer 110. Instead, the graphics system may apply the changes identified in the change list 104 for the target frame that apply to the square intersecting portion 118 of the dirty regions 106, which may be just the changes to the circular cursor between the intermediate frame and the target frame.

The changes to the target frame in the intersection portions 118 of the dirty regions 106 may obscure the changes to the intermediate frame without necessarily obscuring every graphic under the target frame. For example, the changes to the target frame may form a semitransparent layer with respect to a background image in the back buffer 110 or with respect to an image represented in another buffer. If the back buffer 110 is an application buffer, for example, the image rendered in the back buffer 110 may be semitransparent with respect to an image in the display buffer and/or images represented in other application buffers. The values of pixels in the intersecting portions 118 that are actually changed may include any value that indicates the pixels are opaque and/or semi-transparent. For example, the pixels may be specified using RGB (Red Green Blue), RGB565, RGBA (Red Green Blue Alpha), ARGB (Alpha Red Green Blue), ARGB32, ARGB8888, YUV with Alpha, and/or any other color mapping scheme with or without a transparency setting.

The changes between the intermediate frame and the target frame in the intersecting portions 118 of the dirty regions 106 may not obscure all of the changes between the source frame and the intermediate frame in the intersecting portions 118 of the dirty regions 106. If not all of the changes between the source frame and the intermediate frame in the intersecting portions 118 are obscured, then the graphics system may apply a subset of the changes between the source frame and the intermediate frame to the intersecting portions 118 of the dirty regions 106 in the back buffer 110. For example, the graphics system may determine the subset of the changes that affect the parts of the intersecting portions 118 that are not obscured, and apply the subset of changes. The graphics system may apply the subset by applying a modified version of the change list 104 for the intermediate frame and/or copying from one of the graphics buffers that represents the intermediate frame.

Alternatively or in addition, the graphics system may determine the non-intersecting portions 114 and 116 of the dirty regions 106 based on a determination of the intersecting portions 118 of the dirty regions 106. For example, the graphics system may determine the intersecting portions 118 of the dirty regions 106 to comprise the portions of the dirty regions 106 of the intermediate frame that intersect with the dirty regions 106 of the target frame where the changes to the intersecting portions 118 between the intermediate frame and the target frame obscure all of the changes to the intersecting portions 118 between the source frame and the intermediate frame. If the changes to the intersecting portions 118 of the dirty regions 106 between the intermediate frame and the target frame do not obscure the changes to the intersecting portions 118 between the source frame and the intermediate frame, then the graphics system may adjust the dirty regions 106 so that the changes between the intermediate frame and the target frame do obscure the changes between the source frame and the intermediate frame in the intersecting portions 118. For example, the graphics system may subdivide the dirty regions 106 to create smaller dirty regions 106 and/or change the shapes of the dirty regions 106 to form adjusted dirty regions 106 so that the changes to the intersecting portions 118 of the adjusted dirty regions 106 between the intermediate frame and the target frame do obscure the changes to the intersecting portions 118 between the source frame and the intermediate frame. After the intersecting portions 118 of the dirty regions 106 are determined, the graphics system may determine the non-intersecting portions 114 and 116 of the dirty regions 106 as the portions of the adjusted dirty regions 106 of the intermediate frame or the target frame that do not intersect with the adjusted dirty regions 106 of the target frame or the intermediate frame, respectively.

At a completion time, $t_4$, the graphics system may cause a buffer flip to occur. As a result, Buffer A is made the front buffer 112, and Buffer B is made the back buffer 110. After the buffer flip, the front buffer 112, Buffer A, may represent the target frame (frame n+1), and the back buffer 110, Buffer B, may represent the intermediate frame (frame n). The graphics system may further repeat one or more of the algorithms described to generate subsequent frames in the sequence of the frames 102. For example, the graphics system may repeat one or more algorithms described above in order to generate a frame n+2 in the back buffer 110, Buffer B, after the buffer flip performed at the completion time, $t_4$, illustrated in FIG. 1B.

The example of updating the graphic buffers 108 based on the dirty regions 106 of the frames 102 illustrated in FIG. 1B is but one example of generating the target frame. In an alternative example, the graphics system may update the non-intersecting portions 114 and 116 of the dirty regions 106 after the graphics system updates the intersecting portions 118 of the dirty buffers 106.

Alternatively or in addition, instead of the graphics system updating the non-intersecting portions 114 and 116 of the dirty regions 106 of both the intermediate and target frames, the graphics system may update the non-intersecting portions 114 of the dirty regions 106 of just the intermediate frame. Then, instead of updating just the intersecting portions 118 of the dirty regions, the graphics system may apply all of the changes indicated in the change list 104 for the target frame, which updates both the non-intersecting portions 116 of the dirty regions 106 of the target frame and the intersecting portions 118 of the dirty regions 106 of the target frame.

As noted above, the graphic buffers 108 may be application buffers or display buffers. Similar to display buffers, the application buffers may also be at least double buffered. For example, the application buffer may include the back buffer 110 and the front buffer 112. The application may write to the back buffer 110 when generating the frame 102 controlled by the application. The frame 102 controlled by the application may be an application window of a windows based operating system, such an operating system for a mobile electronic device, an operating system for a desktop computer or a server, Microsoft Windows®, which is a registered trademark of Microsoft Corporation of Redmond, Wash., and Linux®, which is a registered trademark of Linus Torvalds of Finland. The composition manager, when generating the display buffer, may read from the front buffer 112 of the application buffer.

The source frame, the intermediate frame, and the target frame are illustrated in FIGS. 1A and 1B as the frames n−1, n, and n+1, respectively. However, the source frame, the intermediate frame, and the target frame may be other frames in the sequence that do not, for example, immediately follow each other in the sequence of frames. In some examples, multiple intermediate frames may be between the source frame and the target frame.

Figure 2:
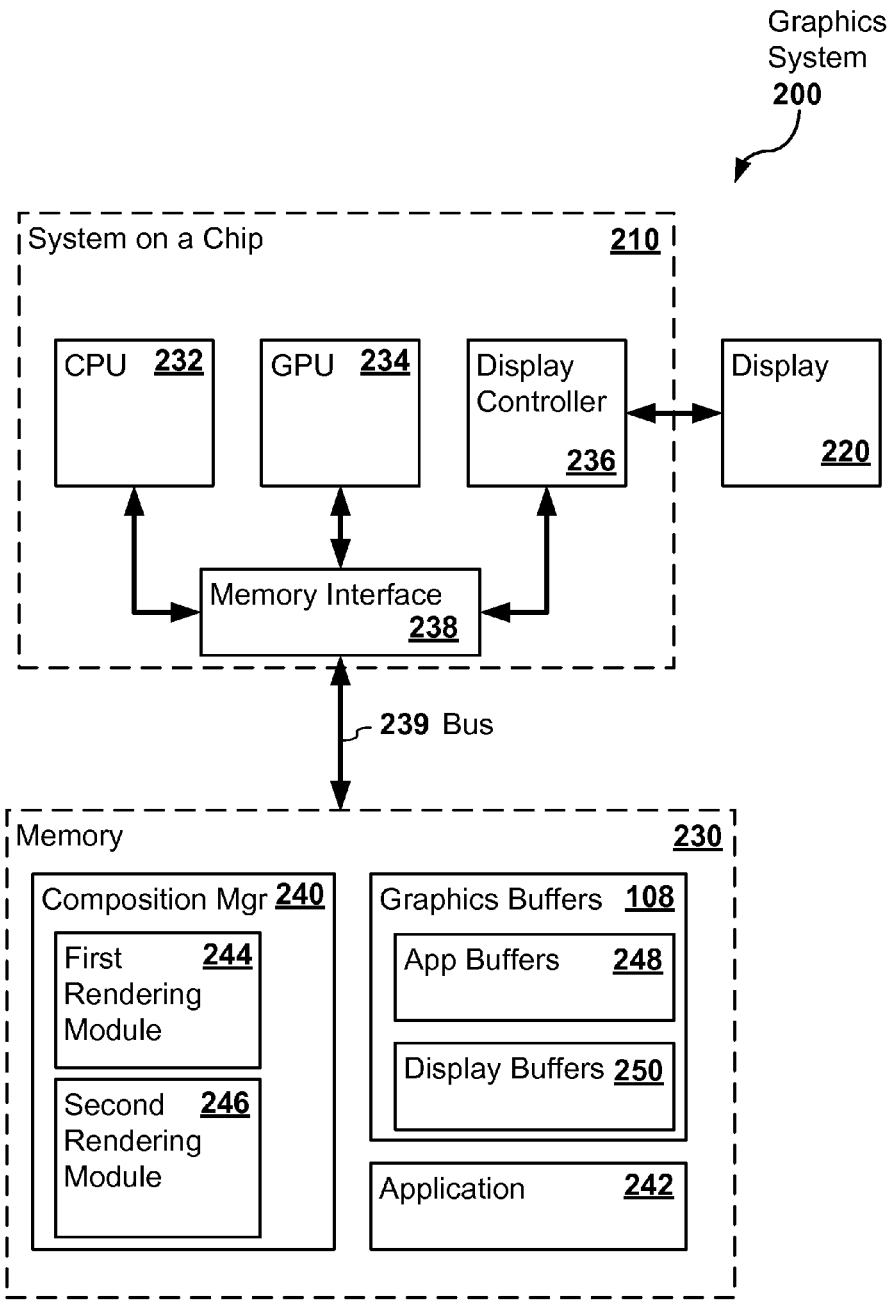
FIG. 2 is a graphics system for updating graphic buffers based on dirty regions of frames.

FIG. 2 illustrates an example of a graphics system 200 for updating the graphic buffers 108 based on the dirty regions 106 of the frames 102. The system 200 may include a system on a chip (SOC) 210, a display 220, and a memory 230 that is external to the SOC 210.

The SOC 210 may be an integrated circuit (IC) that integrates components of a computer, a mobile electronic device, a phone, or other electronic device into a single chip. For example, the SOC 210 may include a central processing unit (CPU) 232, a graphics processing unit (GPU) 234, a display controller 236, and a memory interface 238.

The CPU 232 may be any processor or combination of processors that performs instructions of a computer program operating in the computer or other electronic device. The GPU 234 may be any processor or combination of processors that performs instructions that generate or otherwise process the frames 102 represented in the graphics buffers 108. The instructions executed by the CPU 232 and/or the GPU 234 may be stored in the memory 230 or in some other memory.

The display controller 236 may be any component that reads graphics data, such as pixel information, from one or more of the graphics buffers 108 and provides the data to the display 220.

The memory interface 238 may be any component that manages the transportation of data going to and from the memory 230. For example, the memory interface 238 may be any memory controller, such as a Memory Chip Controller (MCC) or a Double Data Rate2 (DDR2) memory controller used to drive DDR2 SDRAM (double data rate synchronous dynamic random-access memory). The memory interface 238 may communicate with the memory 230 over a bus 239, such as a 64 bit DDR2 bus operating at 400 Megahertz or any other type of bus.

The display 220 may be any device that displays graphical data. Examples of the display 220 include an LED (light emitting diode) display, a LCD (liquid crystal display) display, a CRT (cathode ray tube) display, or any other type of display device.

The memory 230 may be any device that stores computer readable data. The memory 230 may include non-volatile and/or volatile memory, such as a random access memory (RAM), a read-only memory (ROM), an erasable programmable read-only memory (EPROM), flash memory, any other type of memory now known or later discovered, or any combination thereof.

The memory 230 may include any number of the graphics buffers 108, and instructions executable with the CPU 232 and/or the GPU 234, such as a composition manager 240 and an application 242. The composition manager 240 may include a first rendering module 244 and a second rendering module 246. Alternatively or in addition, the application 242 and/or additional applications may include the first rendering module 244 and the second rendering module 246.

The first rendering module 244 may be any component that updates any non-intersecting portions 114 and 116 of the dirty regions 106 of the intermediate frame and/or the target frame in the back buffer 110 as described above. The second rendering module 246 may be any component that updates the intersecting portions 118 of the dirty regions 106 in the back buffer 110 as described above.

The application 242 may be any program and/or process executed by the CPU 232. The memory 230 may include or retain any number of the applications.

During operation of the graphics system 200, the application 242 may generate the frame 102 controlled by the application in an applications buffer 248 included in the graphics buffers 108. The composition manager 240 may assemble the application buffers 248 populated by the applications, such as the application buffer 248 populated by the application 242 illustrated in FIG. 2. From the application buffers 248, the composition manager 240 may generate the frame 102 for a composite image in a display buffer 250 that is included in the graphics buffers 108. The display buffer 250, populated as the back buffer with the composite image 110, may be switched to be front buffer 112. The display controller 236 may read the composite image from the display buffer 250 that is the front buffer 112, and direct the display 220 to display the composite image.

In reading from and writing to the graphics buffers 108, the GPU 234 and/or the CPU 232 may use a substantial portion of the bandwidth of the bus 239. Similarly, the display controller 236 may use a substantial portion of the bandwidth of the bus 239 when reading the display buffer 250 from the memory 230. For example, 10 to 15 percent of the bandwidth of the bus 239 may be used by the display controller 236 as a result of the display controller 236 repeatedly reading the display buffer 250 from the memory 230. The percentage of the bandwidth used by the display controller 236 may depend on a set of factors, such as bus speed, bus width, and the size and the resolution of the image represented in the graphics buffers 108.

The graphics system 200 may decrease the amount of bandwidth of the bus 239 that is consumed by the GPU 234 and/or the CPU 232 when updating the graphics buffers 108. In particular, the graphics system 200 may decrease the bandwidth that is consumed by updating the graphic buffers 108 based on the dirty regions 106 of the frames 102 as described above instead of copying the entire front buffer 112 to the back buffer 110 after the buffer flip. Although the computational load on the GPU 234 and/or the CPU 232 may increase, the bottleneck in many other graphic systems is the bus 239, not the GPU 234 and/or the CPU 232. As a result, updating the graphic buffers 108 based on the dirty regions 106 of the frames 102 as described above may improve the overall performance of the graphics system 200.

The graphics system 200 may include more, fewer, or different elements than illustrated in FIG. 2. For example, the graphics system 200 may include just the GPU 234 and the memory 230. The graphics system 200 may not include the SOC 210, and instead include the CPU 232, the GPU 234, the display controller 236, and the memory interface 238 as discrete components on a circuit board.

Each one of the components of the graphics system 200 may include more, fewer, or different elements than is illustrated in FIG. 2. For example, the memory 230 may include more, fewer, or different modules, graphics buffers, and applications. In some examples, the memory 230 may not include the application buffers 248. In another example, the SOC 210 may include additional components, such as memory.

The system 200 may be implemented in many different ways. For example, although some features are shown stored in computer-readable memories as logic implemented as computer-executable instructions or as data structures in memory, portions of the system 200 and its logic and data structures may be stored on, distributed across, or read from other machine-readable storage media. The media may include memories, hard disks, floppy disks, CD-ROMs, or any other type storage medium. Alternatively or in addition, features and/or modules described as logic implemented as computer-executable instructions or as data structures in memory may be implemented in hardware or in a combination of hardware and software.

The system 200 may be implemented with additional, different, or fewer entities. As one example, the CPU 232 or the GPU 234 may be implemented as any type of processor, such as a microprocessor, a microcontroller, a DSP (digital signal processor), an application specific integrated circuit (ASIC), a field programmable gate array (FPGA), a digital circuit, an analog circuit, discrete logic, any other type of circuit or logic, or any combination thereof. As another example, the memory 230 may be a non-volatile and/or volatile memory, such as a random access memory (RAM), a read-only memory (ROM), an erasable programmable read-only memory (EPROM), flash memory, any other type of memory now known or later discovered, or any combination thereof. The memory 230 may include an optical, magnetic (hard-drive) or any other form of data storage device.

The processing capability of the system 200 may be distributed among multiple entities, such as among multiple processors and memories, optionally including multiple distributed processing systems. Parameters and other data structures may be separately stored and managed, may be incorporated into a single memory or database, may be logically and physically organized in many different ways, and may be implemented with different types of data structures such as linked lists, hash tables, or implicit storage mechanisms. Logic, such as programs or circuitry, may be combined or split among multiple programs, distributed across several memories and processors, and may be implemented in a library, such as a shared library (for example, a dynamic link library (DLL)).

Each one of the processors, such as the CPU 232 and the GPU 234, may be one or more devices operable to execute computer executable instructions or computer code embodied in the memory 230 or in other memory to perform the features of the system 200. The computer code may include instructions executable with the processor. The computer code may be written in any computer language now known or later discovered, such as shader code (for example, OpenGL Shading Language (GLSL)), C++, C#, Java, Pascal, assembly language, or any combination thereof. The computer code may include source code and/or compiled code.

Figure 3A:
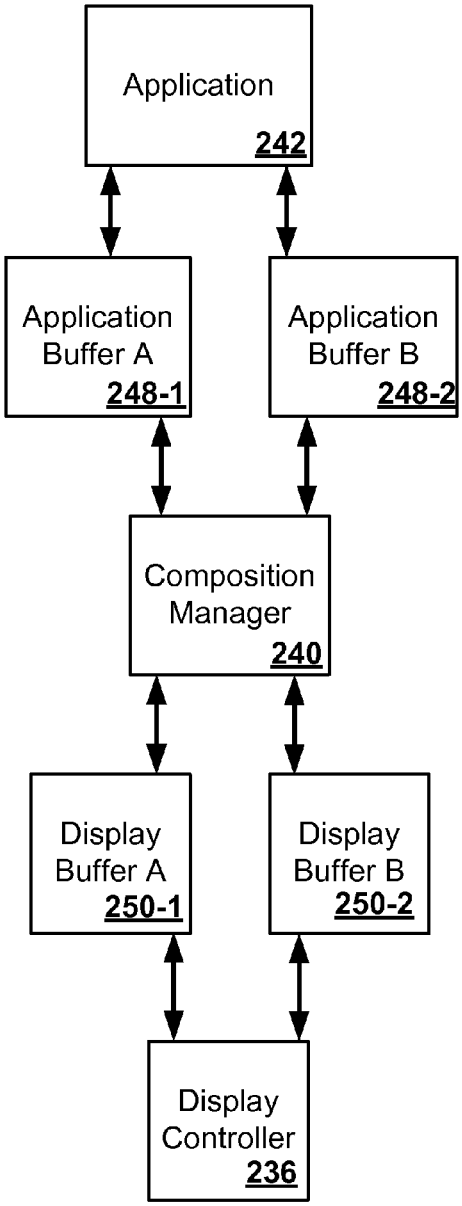
FIG. 3A is an application implementing double buffering with a pair of application buffers.
Figure 3B:
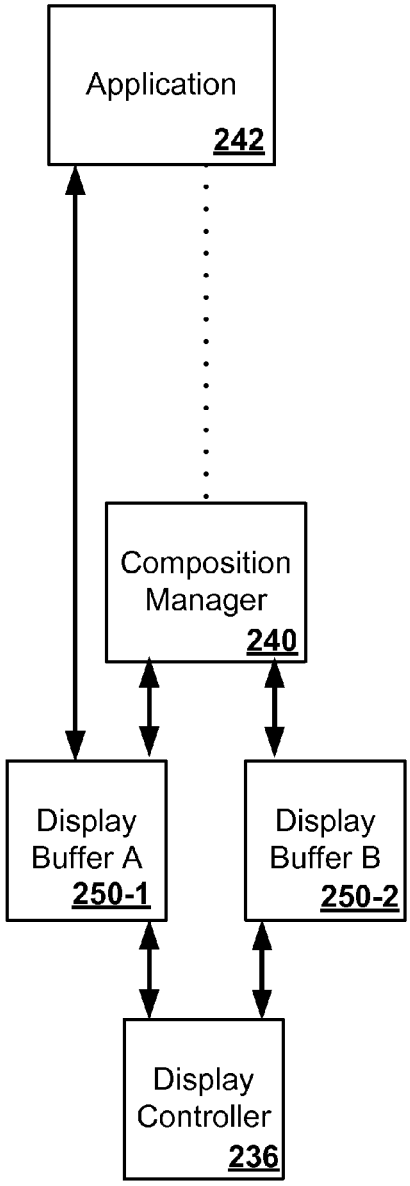
FIG. 3B is an application bypassing application buffers and writing directly to display buffers.

FIG. 3A illustrates an example of the application 242 implementing double buffering with a pair of the application buffers 248, and FIG. 3B illustrates an example of the application 242 bypassing the application buffers 248, individually designated 248-1 and 248-2, and writing directly to the display buffers 250, individually designated 250-1 and 250-2. If the application 242 is rendering graphical content that obscures other images in display buffer 250 from other applications 242 or if the application 242 otherwise has control of a region in the display buffer 250 determined by the frame 102 that the application 242 is to render in the application buffer 248, then the application 242 may write directly to the display buffer 250 instead of to the application buffer 248.

By the application 242 rendering directly to the display buffer 250, the composition manager 240 does not have to copy the rendered content from the application buffer 248 to the display buffer 250 or otherwise reconstruct the content in the display buffer 250.

The composition manager 240, for example, may notify the application 242 when the application 242 has control of a region in the display buffer 250 determined by the frame 102 that the application 242 is to otherwise render in the application buffer 248. If the application 242 has control of the region in the display buffer 250, then the application 242 may generate the frame 102 that the application 242 controls in the region of the display buffer 250 instead of in the application buffer 248. The composition manager 240, when assembling the application buffers 248, may skip copying the application buffer 248 assigned to the application 242 to the display buffer 250 because the application 248 already generated the frame 102 that the application 242 controls in the region of the display buffer 250.

In contrast, if the application 242 does not have control of the region in the display buffer 250, then the application 242 may generate the frame 102 in the application buffer 248. Accordingly, the composition manager 240, when assembling the application buffers 248, may copy the application buffer 248 assigned to the application 242 to the display buffer 250 or otherwise reconstruct the contents of the application buffer 248 in the display buffer 250. Over time, the application 242 may take either approach depending on whether the application 242 has control of the region in the display buffer 250.

Alternatively or in addition, the application 242 may coordinate with the composition manager 240 so that the application 242 may write directly to the display buffer 250 when the application 242 has control of the dirty regions 106 of the intermediate and target frames, but does not necessarily have control of the entire frame 102 represented in the application buffer 248.

Figure 4:
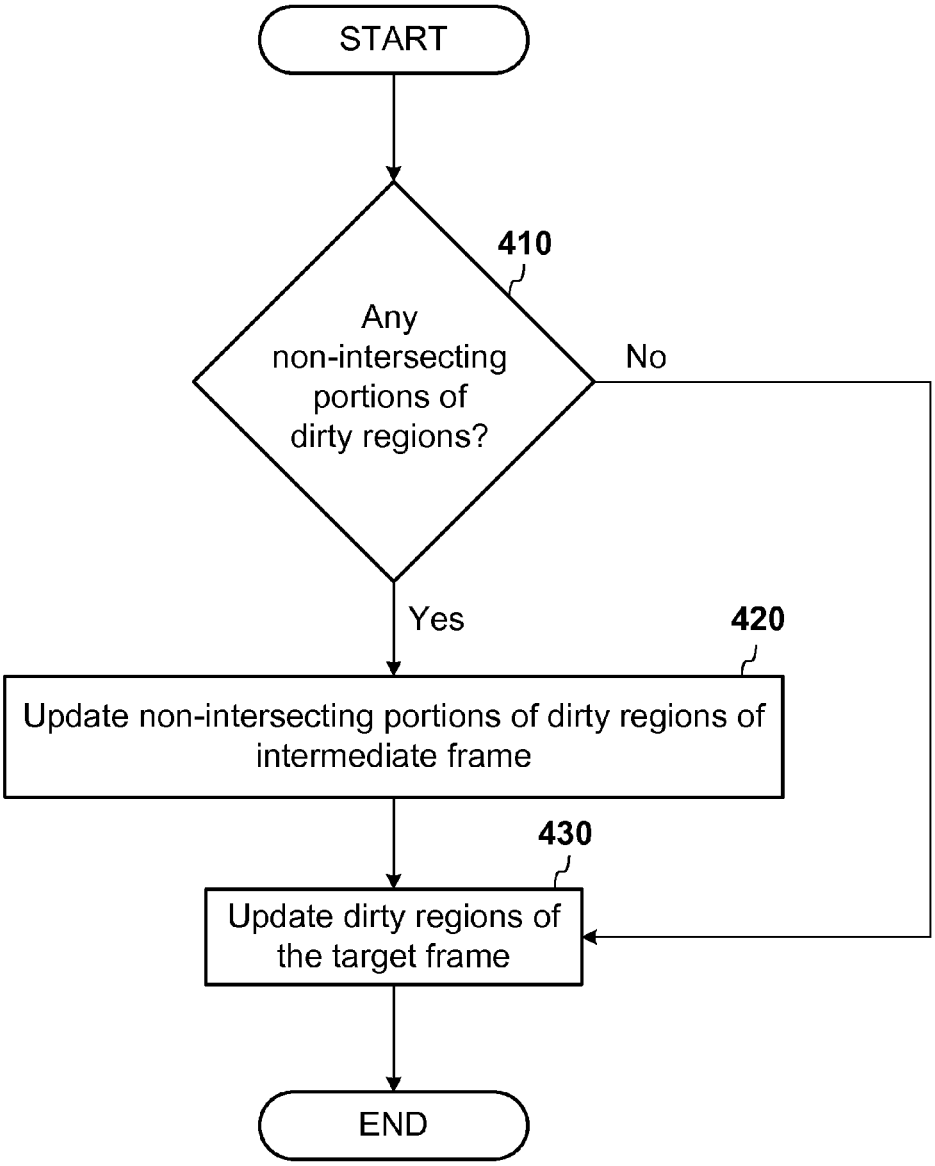
FIG. 4 is a flow diagram of the logic of a graphics system.

FIG. 4 illustrates a flow diagram of an example of the logic of the graphics system 200. The logic may begin with a determination of whether any portions of the dirty regions 106 of the intermediate frame fail to intersect with the dirty regions 106 of the target frame (410). If there are any dirty regions 106 of the intermediate frame that fail to intersect with the dirty regions 106 of the target frame, then the logic may proceed to update the non-intersecting portions 114 of the dirty regions 106 of the intermediate frame (420). Alternatively, if none of the dirty regions 106 of the intermediate frame intersect with the dirty regions 106 of the target frame, then the logic may proceed to update the dirty regions 106 of the target frame (430). The logic may end, for example, with a buffer flip.

The logic may include additional, different, or fewer operations. For example, the logic may begin with a buffer flip. In another example, the logic may include a determination of whether the dirty regions 106 of the target frame obscure an image from the intermediate frame, the source frame, or both.

The operations may be executed in a different order than illustrated in FIG. 4. For example, the dirty regions 106 of the target frame may be updated (430) before the non-intersecting portions 114 of the dirty regions 106 of the intermediate frame are updated (420).

All of the disclosure, regardless of the particular implementation described, is exemplary in nature, rather than limiting. For example, although selected aspects, features, or components of the implementations are depicted as being stored in memories, all or part of systems and methods consistent with the disclosure may be stored on, distributed across, or read from other non-transitory computer-readable storage media, for example, secondary storage devices such as hard disks, floppy disks, and CD-ROMs; or other forms of ROM or RAM. The computer-readable storage media may include CD-ROMs, volatile or non-volatile memory such as ROM and RAM, or any other suitable storage device. Moreover, the various modules are but one example of such functionality and any other configurations of modules encompassing similar functionality are possible.

Furthermore, although specific components were described, methods, systems, and articles of manufacture consistent with the disclosure may include additional or different components. For example, a processor may be implemented as a microprocessor, a microcontroller, a GPU, a CPU, an application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same program. The components may be resident on separate hardware, such as separate removable circuit boards, or share common hardware, such as a same memory and processor for implementing instructions from the memory. Programs may be parts of a single program, separate programs, or distributed across several memories and processors.

The respective logic, software or instructions for implementing the processes, methods and/or techniques discussed above may be provided on computer-readable media or memories or other tangible media, such as a cache, buffer, RAM, removable media, hard drive, other computer readable storage media, or any other tangible media or any combination thereof. The tangible media include various types of volatile and nonvolatile storage media. The functions, acts or tasks illustrated in the figures or described herein may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like. In one embodiment, the instructions are stored on a removable media device for reading by local or remote systems. In other embodiments, the logic or instructions are stored in a remote location for transfer through a computer network or over telephone lines. In yet other embodiments, the logic or instructions are stored within a given computer, central processing unit ("CPU"), graphics processing unit ("GPU"), or system.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions herebefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

While various embodiments have been described, it will be apparent to those of ordinary skill in the art that many more embodiments and implementations are possible within the scope of the disclosure. Accordingly, the disclosure is not to be restricted except in light of the attached claims and their equivalents.

What is claimed is:

1. A system for updating graphics buffers that buffer frames, the system comprising:

a memory comprising a front buffer and a back buffer, wherein the back buffer represents a source frame that is to be updated to a target frame, the front buffer represents an intermediate frame, and the intermediate frame is after the source frame and before the target frame in a sequence of frames; and a processor in communication with the memory, the memory further comprising:

a first rendering module configured to cause the processor to update a non-intersecting portion of a first set of dirty regions of the intermediate frame in the back buffer with changes between the source frame and the intermediate frame that are applicable to the non-intersecting portion, wherein the non-intersecting portion of the first set of dirty regions of the intermediate frame is determined not to intersect a second set of dirty regions of the target frame, the changes between the source frame and the intermediate frame are contained within the first set of dirty regions, and changes between the intermediate frame and the target frame are contained within the second set of dirty regions, wherein the second set of dirty regions of the target frame includes an intersecting portion of the second set of dirty regions of the target frame that intersects the first set of dirty regions, and wherein the changes between the source frame and the intermediate frame are applied to the back buffer differently in the non- intersecting portion than in the intersecting portion; and a second rendering module configured to cause the processor to update the second set of dirty regions of the target frame in the back buffer with the changes between the intermediate frame and the target frame.

2. The system of claim 1, wherein the second rendering module is further configured to cause the processor to update the intersecting portion of the second set of dirty regions of the target frame in the back buffer through an application of at least a subset of the changes between the intermediate frame and the target frame but not the changes between the source frame and the intermediate frame, and wherein the intersecting portion of the second set of dirty regions of the target frame is determined to intersect the first set of dirty regions of the intermediate frame.

3. The system of claim 1, wherein the first rendering module is further configured to cause the processor to copy the non-intersecting portion of the first set of dirty regions of the intermediate frame from the front buffer to the back buffer.

4. The system of claim 1, wherein the first rendering module is further configured to cause the processor to modify a change list that identifies the changes between the source frame and the intermediate frame so that the change list excludes changes to the intersecting portion of the second set of dirty regions.

5. The system of claim 1, wherein the first rendering module is further configured to cause the processor to either copy the non-intersecting portion from the front buffer to the back buffer or apply changes identified in a change list to the non-intersecting portion in the back buffer based on a characteristic of the non-intersecting portion.

6. The system of claim 5, wherein the first rendering module is further configured to cause the processor to copy the non-intersecting portion if the non-intersecting portion is not rectangular and to apply changes identified in the change list to the non-intersecting portion if the non-intersecting portion is rectangular.

7. A non-transitory computer-readable storage medium encoded with computer executable instructions, the computer executable instructions executable with a processor, the computer-readable storage medium comprising:

instructions executable to determine a non-intersecting portion of a first set of dirty regions of an intermediate frame in a graphics buffer, wherein changes between a source frame and an intermediate frame are contained within the first set of dirty regions, and changes between the intermediate frame and a target frame are contained within a second set of dirty regions of the target frame, wherein the source frame is before the intermediate frame in a sequence of frames, and the intermediate frame is before the target frame in the sequence of frames, wherein the non-intersecting portion of the first set of dirty regions of the intermediate frame is determined not to intersect the second set of dirty regions of the target frame, wherein the second set of dirty regions includes an intersecting portion that intersects the first set of dirty regions;

instructions executable to update the non-intersecting portion the first set of dirty regions in the graphics buffer with the changes between the source frame and the intermediate frame that are applicable to the non-intersecting portion; and instructions executable to update the second set of dirty regions of the target frame in the graphics buffer with the changes between the intermediate frame and the target frame.

8. The computer-readable storage medium of claim 7 further comprising instructions executable to determine whether a single application controls a region in a display buffer that corresponds to the target frame, and to include the graphics buffer in the display buffer instead of in an application buffer if the single application is determined to control the region in the display buffer that corresponds to the target frame and to include the graphics buffer in the application buffer if the single application is determined not to control the region in the display buffer that corresponds to the target frame.

9. The computer-readable storage medium of claim 7, further comprising instructions executable to update a plurality of non-intersecting portions of a plurality of dirty regions of a plurality of intermediate frames in a graphics buffer with changes that are applicable to the non-intersecting portions of the dirty regions of the intermediate frames, wherein the non-intersecting portions of the dirty regions of the intermediate frames fail to intersect the second set of dirty regions of the target frame, and the intermediate frames are between the source frame and the target frame.

10. The computer-readable storage medium of claim 7, further comprising instructions executable to adjust the first and the second sets of the dirty regions so that the changes between the intermediate frame and the target frame obscure the changes between the source frame and the intermediate frame in the intersecting portion of the second set of the dirty regions.

11. A computer-implemented method to update graphics buffers that buffer frames, the method comprising:

updating a non-intersecting portion of a first set of dirty regions of an intermediate frame in a graphics buffer with changes between a source frame and the intermediate frame that are applicable to the non-intersecting portion, wherein the non-intersecting portion of the first set of dirty regions of the intermediate frame is determined not to intersect a second set of dirty regions of a target frame, the target frame is after the intermediate frame in a sequence of frames, the intermediate frame is after the source frame in the sequence of frames, the changes between the source frame and the intermediate frame are contained within the first set of dirty regions, changes between the intermediate frame and the target frame are contained within the second set of dirty regions, wherein the second set of dirty regions of the target frame includes an intersecting portion of the second set of dirty regions that intersects the first set of dirty regions, wherein the non-intersecting portion of the first set of dirty regions in the graphics buffer is updated differently than the intersecting portion of the second set of dirty regions with respect to the changes between the source frame and the intermediate frame; and updating the second set of dirty regions of the target frame in the graphics buffer with the changes between the intermediate frame and the target frame.

12. The method of claim 11, wherein updating the second set of dirty regions of the target frame comprises updating the intersecting portion of the second set of dirty regions of the target frame in the graphics buffer based on a change list that identifies the changes between the intermediate frame and the target frame, wherein the intersecting portion of the second set of dirty regions of the target frame is determined to intersect the first set of dirty regions of the intermediate frame.

13. The method of claim 11, wherein the graphics buffer is a first graphics buffer, and updating the non-intersecting portion of the first set of dirty regions of the intermediate frame comprises copying the non-intersecting portion from a second graphics buffer that represents the intermediate frame to the first graphics buffer.

14. The method of claim 11, wherein updating the non-intersecting portion of the first set of dirty regions of the intermediate frame comprises applying changes identified in a change list to the non-intersecting portion of the first set of dirty regions of the intermediate frame in the graphics buffer, wherein the change list identifies changes between the source frame and the intermediate frame.

15. The method of claim 11, wherein the graphics buffer is a first graphics buffer, and updating the non-intersecting portion of the first set of dirty regions of the intermediate frame comprises determining whether to copy the non-intersecting portion from a second graphics buffer or to apply changes identified in a change list to the non-intersecting portion in the first graphics buffer based on a characteristic of the non-intersecting portion.

16. The method of claim 15, wherein determining whether to copy the non-intersecting portion comprises determining that the non-intersecting portion is to be copied from the second graphics buffer that represents the intermediate frame to the first graphics buffer if a size of the non-intersecting portion exceeds a threshold size, and that changes identified in the change list are to be applied to the non-intersecting portion in the first graphics buffer if the size of the non-intersecting portion does not exceed the threshold size.

17. The method of claim 11, wherein the intersecting portion of the second set of dirty regions in the graphics buffer is not updated with the changes between the source frame and the intermediate frame.

18. The method of claim 11 further comprising updating the intersecting portion of the second set of dirty regions in the graphics buffer with the changes between the source frame and the intermediate frame that apply to the intersecting portion of the second set of dirty regions.

* * * * *